US010863257B1

(12) United States Patent
Pierce et al.

(10) Patent No.: US 10,863,257 B1
(45) Date of Patent: Dec. 8, 2020

(54) METHOD OF ASSEMBLING A LOUDSPEAKER

(71) Applicant: Sonos, Inc., Santa Barbara, CA (US)

(72) Inventors: Derrick Pierce, Santa Barbara, CA (US); Petr Stolz, Shenzhen (CN); Charles LaColla, Santa Barbara, CA (US)

(73) Assignee: Sonos, Inc., Santa Barbara, CA (US)

( * ) Notice: Subject to any disclaimer, the term of this patent is extended or adjusted under 35 U.S.C. 154(b) by 0 days.

(21) Appl. No.: 15/976,578

(22) Filed: May 10, 2018

(51) Int. Cl.

| | |
|---|---|
| ***H01R 31/00*** | (2006.01) |
| ***H04R 1/06*** | (2006.01) |
| ***H01B 7/00*** | (2006.01) |
| ***H04R 9/06*** | (2006.01) |
| ***H04R 9/02*** | (2006.01) |
| ***H01B 13/012*** | (2006.01) |

(52) U.S. Cl.
CPC ..... *H04R 1/06* (2013.01); *H01B 7/0045* (2013.01); *H01B 13/01209* (2013.01); *H04R 9/025* (2013.01); *H04R 9/06* (2013.01); *H04R 2400/11* (2013.01)

(58) Field of Classification Search
CPC . H04R 1/06; H04R 9/025; H04R 9/06; H01B 7/0045; H01B 13/01209
See application file for complete search history.

(56) References Cited

U.S. PATENT DOCUMENTS

| | | | |
|---|---|---|---|
| 5,440,644 | A | 8/1995 | Farinelli et al. |
| 5,761,320 | A | 6/1998 | Farinelli et al. |
| 5,923,902 | A | 7/1999 | Inagaki |
| 6,032,202 | A | 2/2000 | Lea et al. |
| 6,256,554 | B1 | 7/2001 | DiLorenzo |
| 6,404,811 | B1 | 6/2002 | Cvetko et al. |
| 6,469,633 | B1 | 10/2002 | Wachter |
| 6,522,886 | B1 | 2/2003 | Youngs et al. |
| 6,611,537 | B1 | 8/2003 | Edens et al. |
| 6,631,410 | B1 | 10/2003 | Kowalski et al. |

(Continued)

FOREIGN PATENT DOCUMENTS

| | | |
|---|---|---|
| EP | 1389853 A1 | 2/2004 |
| WO | 200153994 | 7/2001 |
| WO | 2003093950 A2 | 11/2003 |

OTHER PUBLICATIONS

AudioTron Quick Start Guide, Version 1.0, Mar. 2001, 24 pages.

(Continued)

*Primary Examiner* — Paul D Kim

(57) ABSTRACT

A method of assembling a loudspeaker may include resiliently coupling a voice coil assembly to a transducer basket, the voice coil assembly including a voice coil and first and second lead wires having corresponding proximal and distal ends, where the proximal ends of the lead wires are attached to the voice coil. The method also includes forming a first segment of the first lead wire into a first shape, and forming a second segment of the second lead wire into a second shape. The method also includes affixing an intermediate portion of the first lead wire to a first location on the transducer basket, and affixing an intermediate portion of the second lead wire to a second location on the transducer basket. The method also includes conductively coupling the distal ends of the first and second lead wires to a harness configured to directly connect to an amplifier board.

10 Claims, 7 Drawing Sheets

(56) References Cited

U.S. PATENT DOCUMENTS

| | | | | |
|---|---|---|---|---|
| 6,757,517 | B2 | 6/2004 | Chang | |
| 6,778,869 | B2 | 8/2004 | Champion | |
| 7,130,608 | B2 | 10/2006 | Hollstrom et al. | |
| 7,130,616 | B2 | 10/2006 | Janik | |
| 7,143,939 | B2 | 12/2006 | Henzerling | |
| 7,236,773 | B2 | 6/2007 | Thomas | |
| 7,295,548 | B2 | 11/2007 | Blank et al. | |
| 7,391,791 | B2 | 6/2008 | Balassanian et al. | |
| 7,483,538 | B2 | 1/2009 | McCarty et al. | |
| 7,571,014 | B1 | 8/2009 | Lambourne et al. | |
| 7,630,501 | B2 | 12/2009 | Blank et al. | |
| 7,643,894 | B2 | 1/2010 | Braithwaite et al. | |
| 7,657,910 | B1 | 2/2010 | McAulay et al. | |
| 7,853,341 | B2 | 12/2010 | McCarty et al. | |
| 7,970,162 | B2 * | 6/2011 | Sumitani | H04R 9/043 381/400 |
| 7,987,294 | B2 | 7/2011 | Bryce et al. | |
| 8,014,423 | B2 | 9/2011 | Thaler et al. | |
| 8,045,952 | B2 | 10/2011 | Qureshey et al. | |
| 8,103,009 | B2 | 1/2012 | McCarty et al. | |
| 8,234,395 | B2 | 7/2012 | Millington et al. | |
| 8,452,040 | B2 * | 5/2013 | Perovic, Sr. | H04R 1/2819 381/397 |
| 8,483,853 | B1 | 7/2013 | Lambourne | |
| 8,942,252 | B2 | 1/2015 | Balassanian et al. | |
| 10,021,488 | B2 * | 7/2018 | Stolz | H04R 9/046 |
| 2001/0042107 | A1 | 11/2001 | Palm | |
| 2002/0022453 | A1 | 2/2002 | Balog et al. | |
| 2002/0026442 | A1 | 2/2002 | Lipscomb et al. | |
| 2002/0106101 | A1 * | 8/2002 | White | H04R 9/022 381/400 |
| 2002/0124097 | A1 | 9/2002 | Isely et al. | |
| 2003/0157951 | A1 | 8/2003 | Hasty | |
| 2004/0024478 | A1 | 2/2004 | Hans et al. | |
| 2007/0142944 | A1 | 6/2007 | Goldberg et al. | |
| 2008/0056527 | A1 * | 3/2008 | Adamson | H04R 9/022 381/409 |
| 2016/0309262 | A1 * | 10/2016 | Popken | H04R 31/006 |

OTHER PUBLICATIONS

AudioTron Reference Manual, Version 3.0, May 2002, 70 pages.
AudioTron Setup Guide, Version 3.0, May 2002, 38 pages.
Bluetooth. "Specification of the Bluetooth System: The ad hoc SCATTERNET for affordable and highly functional wireless connectivity," Core, Version 1.0 A, Jul. 26, 1999, 1068 pages.
Bluetooth. "Specification of the Bluetooth System: Wireless connections made easy," Core, Version 1.0 B, Dec. 1, 1999, 1076 pages.
Dell, Inc. "Dell Digital Audio Receiver: Reference Guide," Jun. 2000, 70 pages.
Dell, Inc. "Start Here," Jun. 2000, 2 pages.
"Denon 2003-2004 Product Catalog," Denon, 2003-2004, 44 pages.
Jo et al., "Synchronized One-to-many Media Streaming with Adaptive Playout Control," Proceedings of SPIE, 2002, pp. 71-82, vol. 4861.
Jones, Stephen, "Dell Digital Audio Receiver: Digital upgrade for your analog stereo," Analog Stereo, Jun. 24, 2000 retrieved Jun. 18, 2014, 2 pages.
Louderback, Jim, "Affordable Audio Receiver Furnishes Homes With MP3," TechTV Vault. Jun. 28, 2000 retrieved Jul. 10, 2014, 2 pages.
Palm, Inc., "Handbook for the Palm VII Handheld," May 2000, 311 pages.
Presentations at WinHEC 2000, May 2000, 138 pages.
United States Patent and Trademark Office, U.S. Appl. No. 60/490,768, filed Jul. 28, 2003, entitled "Method for synchronizing audio playback between multiple networked devices," 13 pages.
United States Patent and Trademark Office, U.S. Appl. No. 60/825,407, filed Sep. 12, 2006, entitled "Controlling and manipulating groupings in a multi-zone music or media system," 82 pages.
UPnP; "Universal Plug and Play Device Architecture," Jun. 8, 2000; version 1.0; Microsoft Corporation; pp. 1-54.
Yamaha DME 64 Owner's Manual; copyright 2004, 80 pages.
Yamaha DME Designer 3.5 setup manual guide; copyright 2004, 16 pages.
Yamaha DME Designer 3.5 User Manual; Copyright 2004, 507 pages.

* cited by examiner

METHOD OF ASSEMBLING A LOUDSPEAKER

FIELD OF THE DISCLOSURE

The disclosure is related to consumer goods and, more particularly, to methods, systems, products, features, services, and other elements directed to media playback or some aspect thereof.

BACKGROUND

A loudspeaker in the context of the present application is an electroacoustic transducer that produces sound in response to an electrical audio signal input. Originally, non-electrical loudspeakers were developed as accessories to telephone systems. Today, electronic amplification for applications such as audible communication and enjoyment of music has made loudspeakers ubiquitous.

A common form of loudspeaker uses a transducer diaphragm (such as, for example, a paper cone) supporting a voice coil electromagnet acting on a permanent magnet. Traditionally, the loudspeaker may contain one or more terminals to receive an audio signal input. The audio signal input may then pass from the terminal to a pair of lead wires that carry the signal to the voice coil, which drives the audio output of the loudspeaker by vibrating the transducer diaphragm.

Based on the application, different parameters may be selected for the design of the loudspeaker. For instance, the frequency response of sound produced by a loudspeaker may depend on the shape, size, and rigidity of the diaphragm, and efficiency of the voice coil electromagnet, among other factors. Accordingly, the diaphragm and voice coil electromagnet may be selected based on a desired frequency response of the loudspeaker. In some cases, for improved reproduction of sound covering a wide frequency range, multiple loudspeakers may be used collectively, each configured to optimally reproduce different frequency subranges within the wide frequency range.

As applications of loudspeakers continue to broaden, different loudspeakers designed for particular applications continue to be developed.

BRIEF DESCRIPTION OF THE DRAWINGS

Features, aspects, and advantages of the presently disclosed technology may be better understood with regard to the following description, appended claims, and accompanying drawings where:

Figure 1:
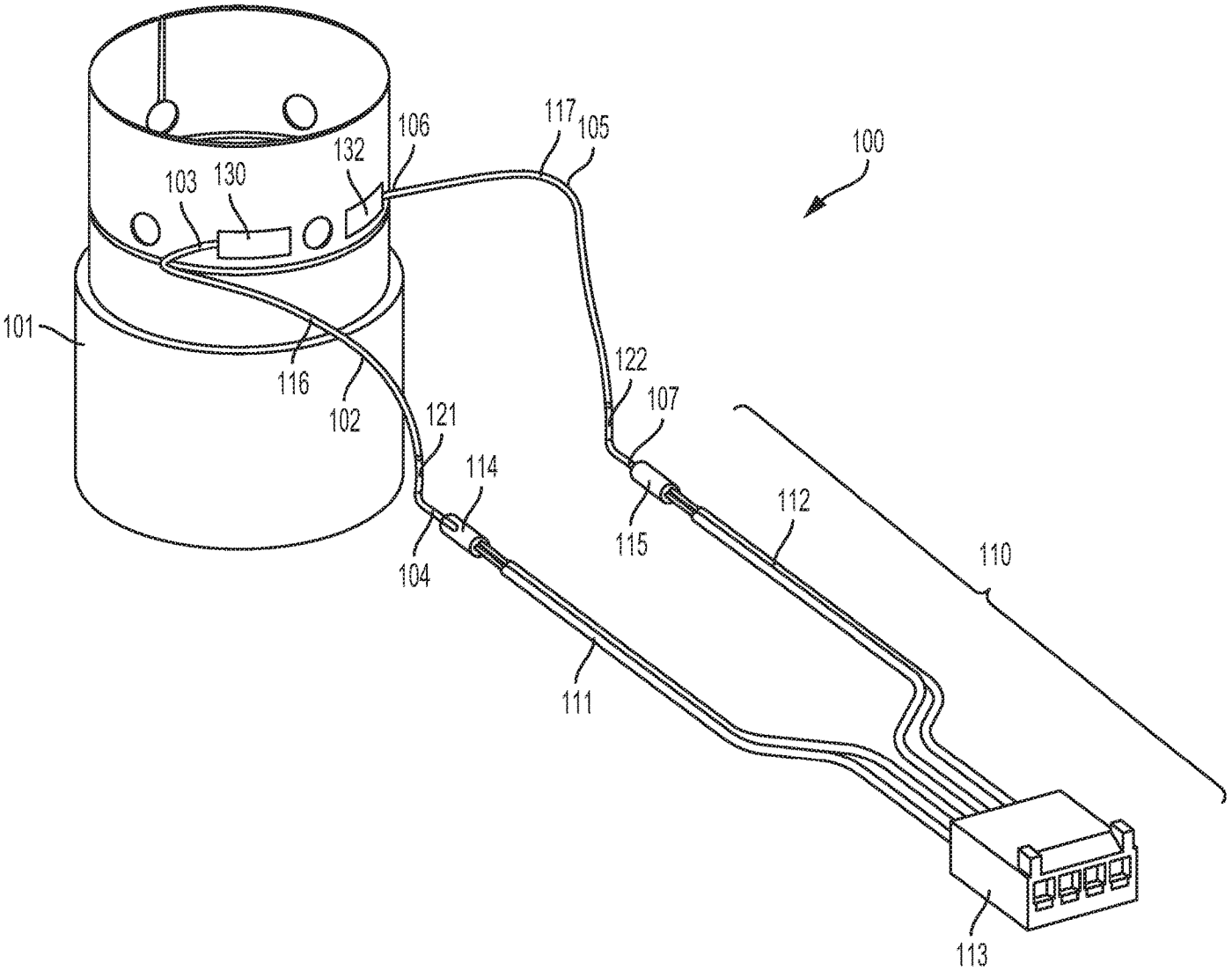
FIG. 1 is an isometric view of a voice coil assembly, according to an example embodiment.

The drawings are for the purpose of illustrating example embodiments and are not necessarily to scale. It is understood that the inventions are not limited to the arrangements and instrumentalities shown in the drawings.

DETAILED DESCRIPTION

I. Overview

Examples described herein involve configurations of a loudspeaker that may allow for easier and more efficient assembly of the loudspeaker. In particular, the loudspeaker may contain a pair of lead wires extending from the voice coil that must be positioned and secured in such a way that they do not interfere with the operation of the loudspeaker. Examples herein involve a lead wire harness for use in the assembly of a loudspeaker, and methods for shaping and positioning the lead wires extending from a loudspeaker voice coil.

In traditional loudspeaker construction, as noted above, the first and second lead wires that extend from the voice coil are typically terminated at a terminal board within the loudspeaker, which is often fastened to the loudspeaker basket although other locations are possible. This termination of the first and second lead wires is traditionally accomplished after the voice coil is coupled to the spider and the transducer basket, and can be a labor-intensive process that involves feeding the lead wires into ports on the terminal board, and then soldering them into place, for instance. Terminal leads are later added to conductively connect the terminal board to an amplifier board, which provides the audio input signal.

In contrast to traditional loudspeakers, examples discussed herein include a lead wire harness that may be coupled to the voice coil prior to the voice coil being coupled to the spider and the transducer basket. In some cases, this may eliminate a need for the traditional terminal board, as the lead wires extending from the voice coil are already terminated at the lead wire harness. Further, the examples herein discuss positioning and securing the lead wires in a controlled manner to provide a desired shape and orientation of the lead wires.

Additionally, in some implementations, the lead wire harness may be compatible with other features, such as a low impedance voice coil and a transducer basket that is formed from plastic, and may be integrally formed with a portion of the outer housing of the loudspeaker. These features may be advantageous in some loudspeaker implementations, such as a portable, battery-powered loudspeaker as further discussed below.

As indicated above, the examples involve a lead wire harness for use within a loudspeaker. In one aspect, a method of assembling a loudspeaker is provided. The method includes resiliently coupling a voice coil assembly to a transducer basket, where the voice coil assembly includes a voice coil, and first and second lead wires having corresponding proximal and distal ends, where the proximal ends of the first and second lead wires are attached to the voice coil, and where the distal ends of the first and second lead wires extend away from the voice coil. The method also includes forming a first segment of the first lead wire into a first shape, where the first segment of the first lead wire has a predetermined first length between the proximal end of the first lead wire and an intermediate portion of the first lead wire. The method also includes forming a second segment of the second lead wire into a second shape, where the second segment of the second lead wire has a predetermined second length between the proximal end of the second lead wire and an intermediate portion of the second lead wire. The method also includes affixing the intermediate portion of the first lead wire to a first location on the transducer basket, and affixing the intermediate portion of the second lead wire to a second location on the transducer basket. The method also includes conductively coupling the distal ends of the first and second lead wires to a harness configured to directly connect to an amplifier board.

In another aspect, a method of assembling a loudspeaker is provided. The method includes resiliently coupling a voice coil assembly to a transducer basket, where the voice coil assembly includes a voice coil, and first and second lead wires having corresponding proximal and distal ends, where the proximal ends of the first and second lead wires are attached to the voice coil, and where the distal ends of the first and second lead wires extend away from the voice coil. The method further includes engaging a first segment of the first lead wire with a die to form the first segment into a first shape, and engaging a second segment of the second lead wire with the die to form the second segment into a second shape. The method further includes attaching an intermediate portion of the first lead wire to a first location on the transducer basket, where the intermediate portion of the first lead wire is located on the first lead wire between the first segment and the distal end of the first lead wire. The method further includes attaching an intermediate portion of the second lead wire to a second location on the transducer basket, where the intermediate portion of the second lead wire is located on the second lead wire between the first segment and the distal end of the first lead wire.

In yet another aspect, a loudspeaker is provided. The loudspeaker includes a voice coil assembly including a voice coil, a first lead wire having a proximal end and a distal end, where a proximal end of the first lead wire is conductively coupled to the voice coil, a second lead wire having a proximal end and a distal end, where a proximal end of the second lead wire is conductively coupled to the voice coil, and a lead wire harness conductively coupled to the distal end of the first lead wire and the distal end of the second lead wire. The loudspeaker also includes a transducer basket flexibly coupled to the voice coil, where the first lead wire is affixed to the transducer basket at an intermediate portion on the first lead wire, where the intermediate portion on the first lead wire is located a predetermined first length from the proximal end of the first lead wire and the distal end of the first lead wire, where the second lead wire is affixed to the transducer basket at an intermediate portion on the second lead wire, where the intermediate portion on the second lead wire is located a predetermined second length from the proximal end of the second lead wire and the distal end of the second lead wire, and where the lead wire harness extends away from the transducer basket.

One of ordinary skill in the art will understand that this disclosure includes numerous other embodiments and/or examples. While some examples described herein may refer to functions performed by given actors such as "users" and/or other entities, it should be understood that this description is for purposes of explanation only. The claims should not be interpreted to require action by any such example actor unless explicitly required by the language of the claims themselves.

II. Example Loudspeaker Configuration and Assembly a. Example Loudspeaker Configurations

FIG. 1 is an isometric view of a voice coil assembly 100. The voice coil assembly 100 includes a voice coil 101, a first lead wire 102, and a second lead wire 105. A proximal end 103 of the first lead wire 102 is conductively coupled to the voice coil 101, while a distal end 104 of the first lead wire 102 extends away from the voice coil 101. Similarly, a proximal end 106 of the second lead wire 105 is conductively coupled to the voice coil 101 while a distal end 107 of the second lead wire 105 extends away from the voice coil 101. In the illustrated example, a resilient adhesive 130 and a resilient adhesive 132 attach the proximal ends 103 and 106, respectively, to the voice coil 101. The resilient adhesives 130 and 132 can, for example, strengthen the coupling and maintain desired orientations of the proximal ends 103 and 106, respectively, where they individually join the voice coil 101. In other examples, however, a non-resilient adhesive or another suitable fastener can be used to attach the proximal ends 103 and 106 to the voice coil 101.

As shown in FIG. 1, the voice coil assembly 100 includes a lead wire harness 110 that is conductively coupled to the first and second lead wires 102 and 105. The lead wire harness 110 includes a first harness lead 111 and a second harness lead 112 that are joined at a connector 113, which may be configured to connect directly to an amplifier board, as further discussed below. Further, the distal end 104 of the first lead wire 102 is attached to the first harness lead 111, and the distal end 107 is attached to the second harness lead 112. In some implementations, the first and second lead wires 102 and 105 may be a first type of conductor, such as a litz wire including a plurality of braided strands. Each strand may include a flat conductive wire wrapped around a filament of cotton or nylon, among other possibilities. This configuration may provide for increased flexibility and distribution of stresses acting on the first and second lead wires 102 and 105 during operation of the loudspeaker 240, due to the vibration of the voice coil 101.

Further, the first and second harness leads 111 and 112 may be a second type of conductor that is different from the first type of conductor. For instance, the first and second harness leads 111 and 112, which may be subject to little or no movement during operation of the loudspeaker 240, may be formed from 22 gauge or heavier speaker wire. Other suitable conductors for the first and second lead wires 102 and 105 and/or the first and second harness leads 111 and 112 are also possible.

In some examples, a crimped connection attaches the first and second lead wires 102 and 105 with the respective first and second harness leads 111 and 112. In other examples, however, other suitable connections (e.g., solder) are possible. In some implementations, the connection between the first lead wire 102 and the first harness lead 111 may be surrounded by a portion of insulated, heat-shrink tubing 114. Likewise, an insulated tubing 115 may surround the connection of the second lead wire 105 with the second harness lead 112. Other suitable connection types and solutions for attaching the lead wires with the harness leads are also possible.

Unlike many traditional modes of assembling a loudspeaker, the voice coil assembly 100 may be assembled substantially as shown in FIG. 1 before being joined with other components of the loudspeaker. In particular, the first lead wire 102 and the second lead wire 105 may be terminated by way of the lead wire harness 110 before the voice coil 101 is coupled to a transducer basket, for instance. After the voice coil 101 and the voice coil assembly 100 are coupled to the transducer basket, via a spider, for instance, the lead wire harness 110 may be routed outside the basket, where the connector 113 may be connected directly to an amplifier board located elsewhere. This configuration will be discussed in further detail below with respect to FIG. 4.

In this way, the lead wire harness 110 may eliminate the need to connect the first lead wire 102, the second lead wire 105, as well as additional terminal leads to a terminal board. Indeed, attachment of the terminal board to the transducer basket may be eliminated completely, which may reduce both time and cost of the loudspeaker assembly.

Furthermore, in a traditional loudspeaker, the connection of the lead wires and additional terminal leads at the terminal board may introduce some resistance, on the order of about 0.1 ohm, for example, which may be significant in implementations having a relatively low impedance voice coil. For instance, for a voice coil with a relatively low impedance of 1.0 ohm, the traditional connections at the terminal board may introduce a loss of approximately 10% between the amplifier board and the voice coil. Conversely, the first and second harness leads 111 and 112 of the lead wire harness 110 may be crimped directly to the first lead wire 102 and the second lead wire 105 as noted above, which may result in a substantially lossless connection between the amplifier board and the voice coil 101. Accordingly, the lead wire harness 110 may be particularly useful in relatively low voltage loudspeaker applications, such as a portable, battery-powered loudspeaker that may utilize a relatively low impedance voice coil to reduce power usage.

Figure 2:
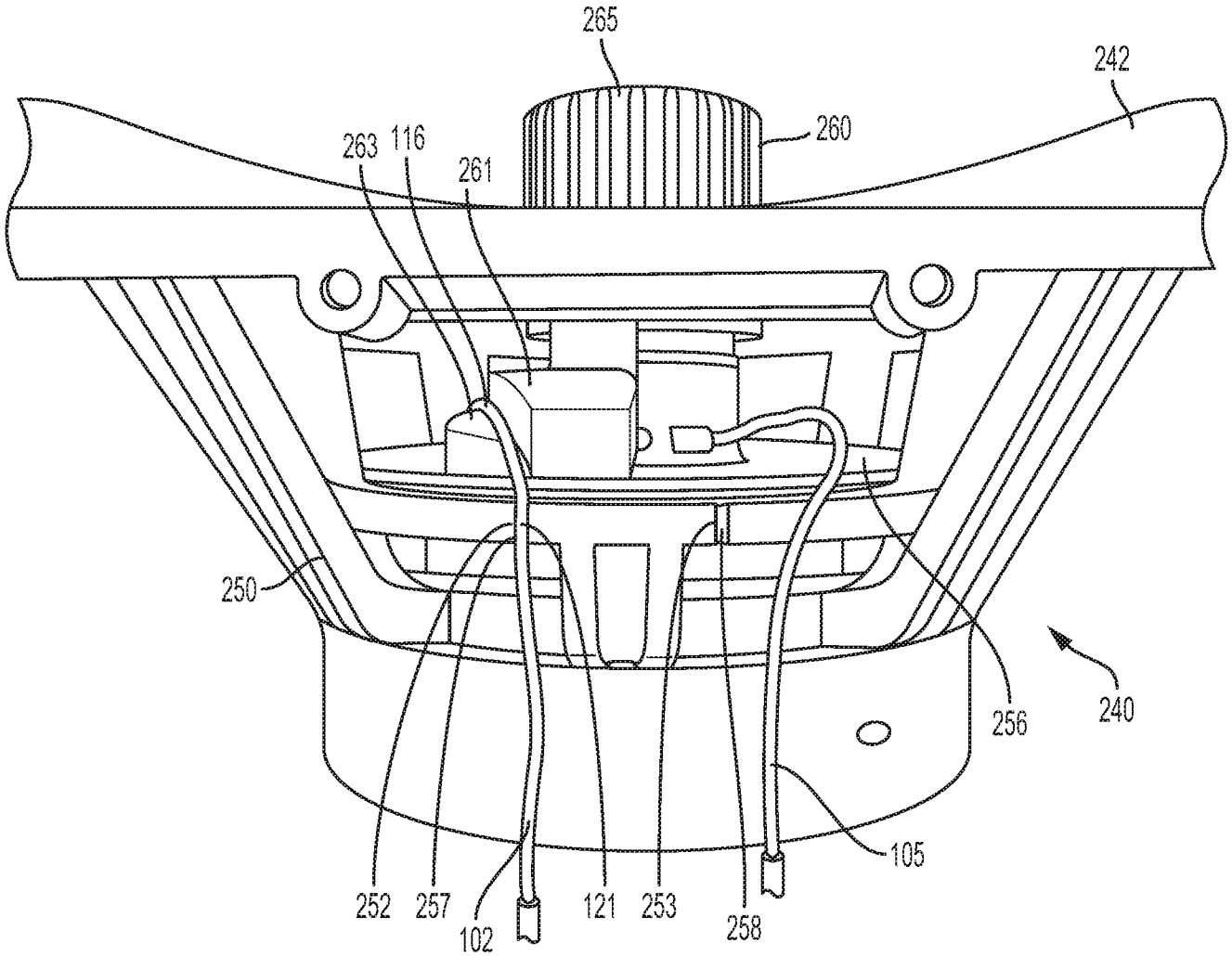
FIG. 2 is a side view of a partially assembled loudspeaker, according to an example embodiment.
Figure 3:
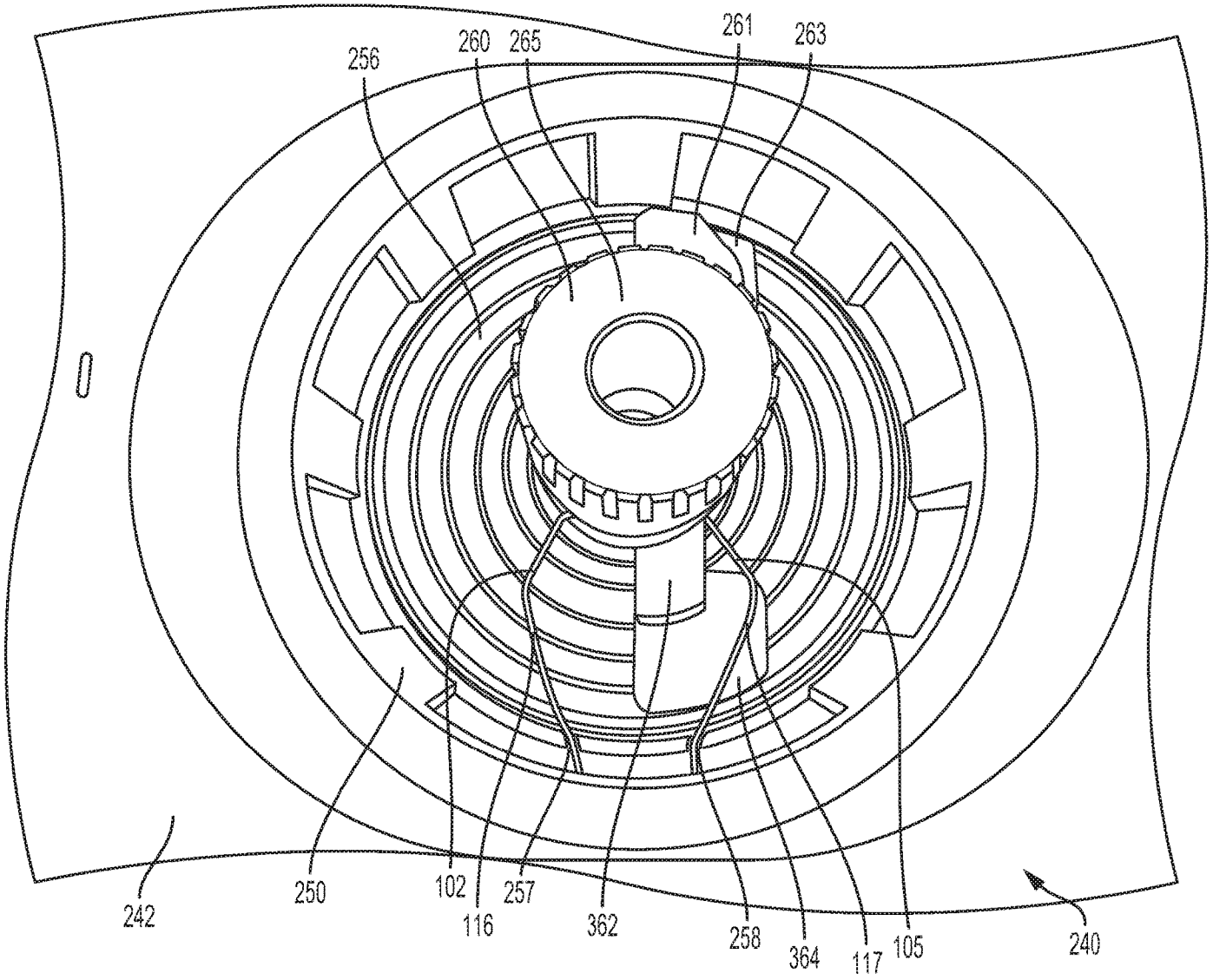
FIG. 3 is a plan view of a partially assembled loudspeaker, according to an example embodiment.
Figure 4:
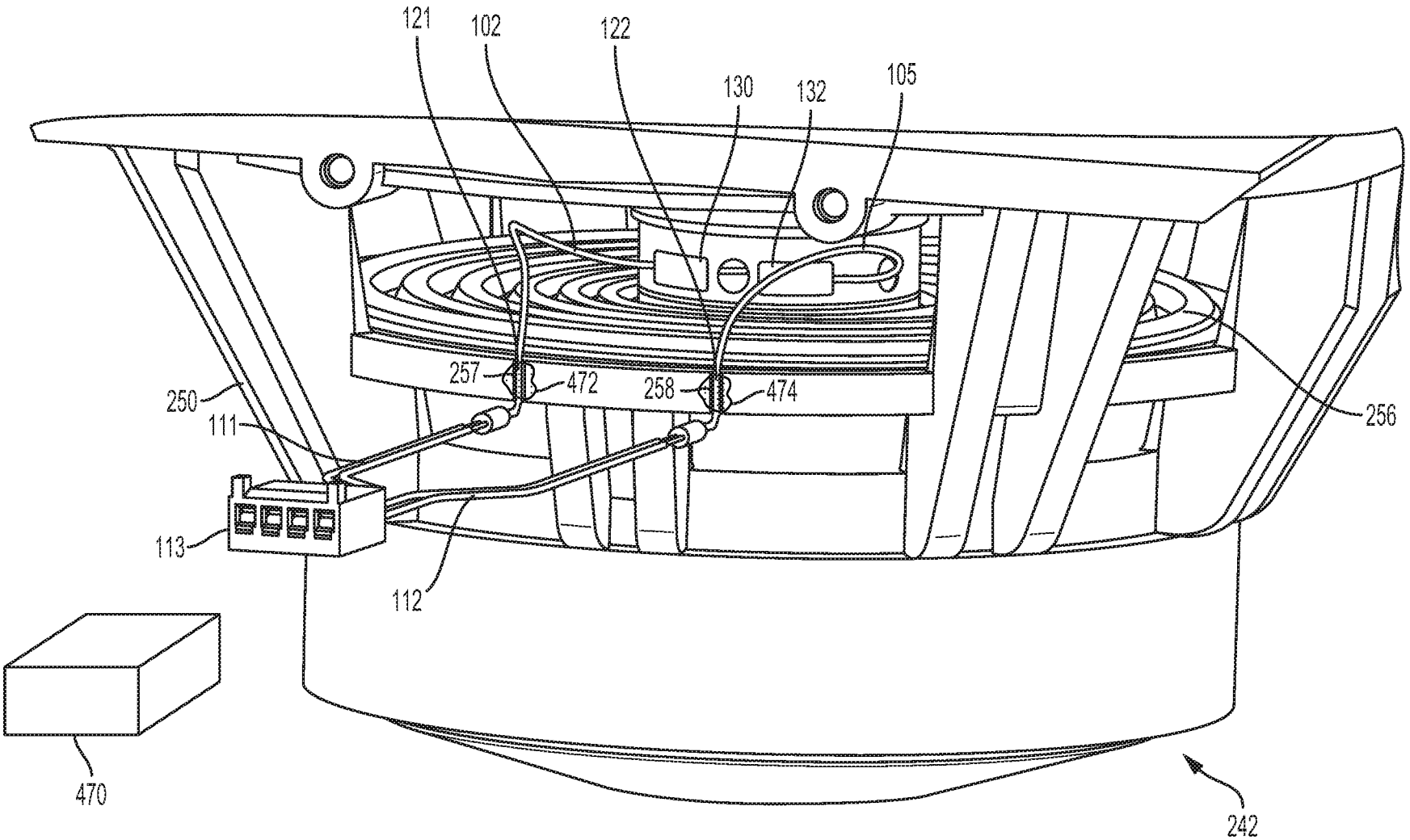
FIG. 4 is an isometric side view of a partially assembled loudspeaker, according to an example embodiment.

FIGS. 2-4 show an example loudspeaker 240 in various stages of assembly. For instance, FIGS. 2-4 show the voice coil assembly 100 coupled to a transducer basket 250, and further illustrate possible embodiments for shaping the first lead wire 102 and the second lead wire 105 within the loudspeaker 240. FIGS. 2-4 also show possible embodiments for securing the first lead wire 102 and the second lead wire 105 to the transducer basket 250. The individual components shown in FIGS. 2-4 will be discussed further below with reference to the FIGS. 6 and 7.

b. Example Implementations for Assembly of a Loudspeaker

Figure 6:
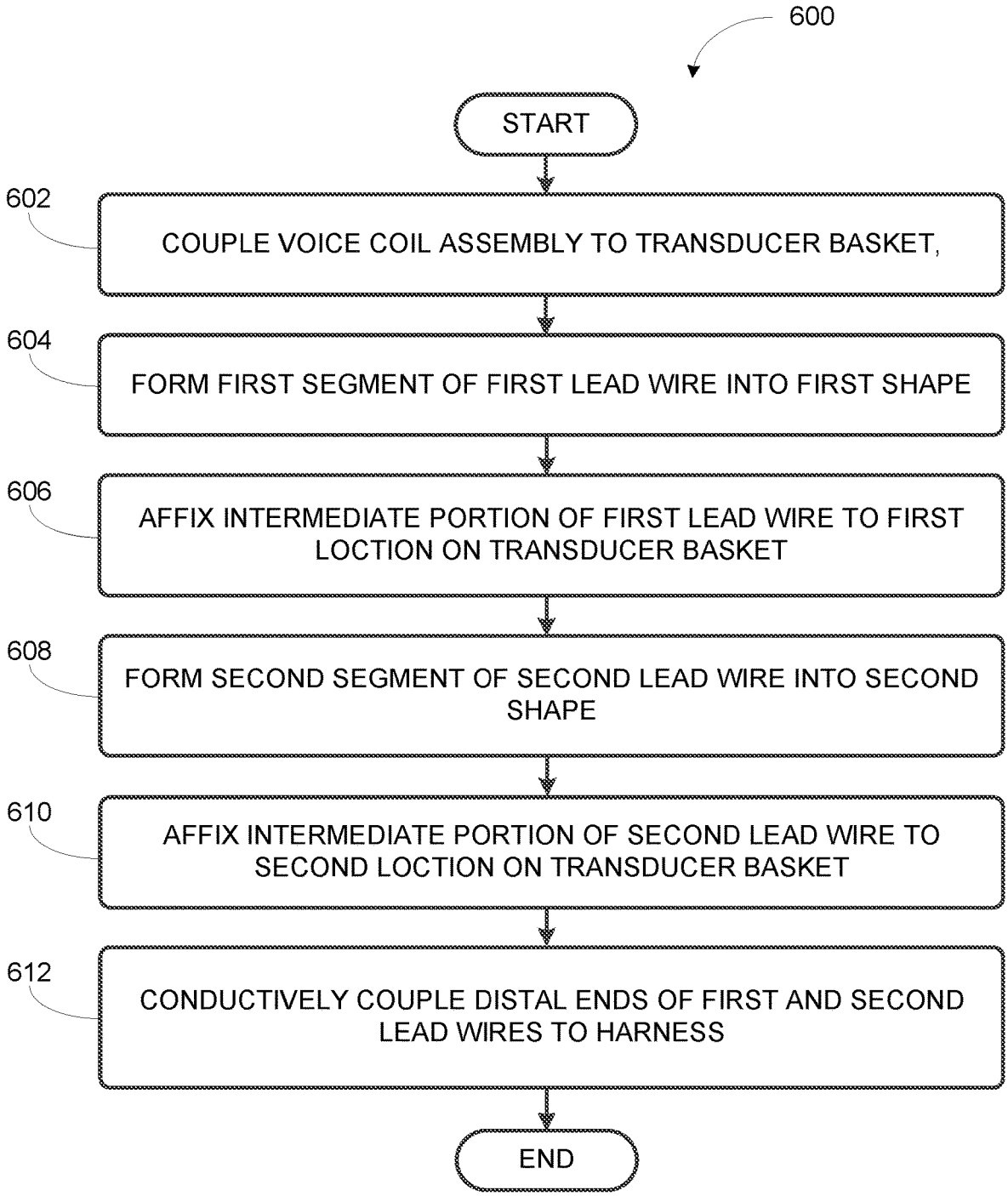
FIG. 6 is a flowchart of an example method of assembling a loudspeaker, according to an example implementation.

FIG. 6 is a flowchart of a method 600 for assembling a loudspeaker, such as the loudspeaker 240 shown in FIGS. 2-4, is shown. At block 602, the method 600 includes resiliently coupling a voice coil assembly, such as the voice coil assembly 100 discussed above and shown in FIG. 1, to a transducer basket. For example, the transducer basket may be the transducer basket 250 shown in FIGS. 2-4, and the voice coil assembly 100 may be resiliently coupled to the transducer basket 250 via a suspension element or a spider 256. For instance, the voice coil 101 may be coupled to an inner diameter of the spider 256 via an adhesive, and an outer diameter of the spider 256 may be coupled to the transducer basket 256 via an adhesive.

The spider 256 may comprise a treated fabric material, flexible rubber, and/or flexible elastomer, for example, that provides a restoring force to return the vibrating voice coil 101 to a neutral position. For instance, the spider 256 may have a concentrically corrugated structure, seen most clearly in FIGS. 3 and 4. Other materials and configurations for the spider 256 may also be possible.

Because the voice coil 101 and the spider 256 are subject to movement during operation of the loudspeaker 240, the disposition of the first and second lead wires 102 and 105 as they extend away from the voice coil 101 may be important. If the lead wires 102 and 105 are too taut, the movement of the voice coil 101 and spider 256 may stress the lead wires 102 and 105 and lead to a failure of the loudspeaker 240. Alternatively, if the lead wires 102 and 105 are provided too much slack between the voice coil 101 and the transducer basket 250, they may contact the spider 256 or the diaphragm during operation. Thus, the first lead wire 102 and the second lead wire 105 each may be secured in a desirable shape, with a desirable length, to reduce the chance of such outcomes.

At block 604, the method 600 includes forming a first segment 116 of the first lead wire 102 into a first shape. For instance, the first segment 116 of the first lead wire 102 may have a predetermined first length between the proximal end 103 of the first lead wire 102 and an intermediate portion 121 of the first lead wire 102. Forming the first segment 116 into the first shape may be accomplished in a number of ways. In some implementations, a die 260, as shown in FIGS. 2 and 3, may be positioned with respect to the transducer basket 250 and the voice coil assembly 100 to facilitate forming the first segment 116 into the first shape.

For example, the die 260 may be slidably engaged with the voice coil 101, such that the die 260 slides onto the top of the voice coil 101. Further, the die may be positioned such that a first die portion 261 is disposed between the voice coil 101 and a first location 252 on the transducer basket 250 where the first lead wire 102 will eventually be attached, as further discussed below.

As shown in FIG. 2, forming the first segment 116 of the first lead wire 102 into a first shape may include extending a portion of the first segment 116 along the first die portion 261. For instance, the first die portion 261 may include a first convex shape 263, and extending the portion of the first segment 116 along and in contact with the first convex shape 263 of the first die portion 261 may form the first segment 116 into a concave shape that generally corresponds to the first convex shape 263 of the first die portion 261. The first lead wire 102 may be secured in this position, as discussed below, and the die 260 may then be removed or repositioned. Thus, the first segment 116 of the lead wire 102 may have a first shape that has a radius of curvature that is concave with respect to the spider 256. In some examples, as shown in FIG. 4, the profile of the first lead wire 102 may include several radii, each being generally concave with respect to the spider 256.

In some implementations, the die 260 may be rotatably engaged with the voice coil 101. In such an implementation, forming the first segment 116 of the first lead wire 102 into the first shape may include rotating the first die portion 261 in a first direction with respect to the voice coil 101 toward the first lead wire 102. For example, the die 260 may be rotatably engaged with the voice coil 101 such that the first die portion 261 is initially positioned in between the first lead wire 102 and the second lead wire 105. The die 260 may then be rotated in a clockwise direction, via a knob 265 located at the top of the die 260, for instance, such that the first die portion 261 is moved toward the first lead wire 102. Markings, indicia, or other features on the voice coil 101 or the spider 256 may indicate a designated position for the first die portion 261 that provides the desired length and shape for the first lead wire 102 when it is extended along the first die portion 261. For example, when the first die portion 261 is in the designated position and the first segment 116 is extended along the first die portion 261, the intermediate portion 121 of the first lead wire 102 may be aligned with the first location 252 on the transducer basket 250.

Accordingly, at block 606, the method 600 includes affixing the intermediate portion 121 of the first lead wire 102 to a first location 252 on the transducer basket 250. For example, the intermediate portion 121 of the first lead wire 102 may be affixed to the transducer basket 250 after it has been formed into the first shape using the die 260. In some embodiments, affixing the first lead wire 102 to the transducer basket 250 may include positioning the intermediate portion 121 of the first lead wire 102 within a first groove 257 in the transducer basket 250, as shown in FIG. 2. The distal end 104 of the first lead wire 102 may then extend away from the first groove 257.

The attachment of the first lead wire 102 to the transducer basket 250 may take number of forms. For example, after positioning the intermediate portion 121 of the first lead wire 102 within the groove 257, a resilient adhesive 472 may be applied to maintain the first lead wire 102 within the groove 257 and in the desired orientation, as seen in FIG. 4. Further, in some implementations, the groove 257 may have edges that are serrated in an inward direction, which may tend to hold the first lead wire 102 in place, either as an alternative to the adhesive 472 or until the adhesive 472 is applied. In other examples, the first lead wire 102 may be affixed to the transducer basket 250 via adhesives only.

In some embodiments, the transducer basket 250 may be formed from plastic, unlike many traditional loudspeaker baskets that are formed from metal. In such an embodiment, the first lead wire 102 may be affixed to the transducer basket 250 by way of a heated die, in addition to or as an alternative to positioning the first lead wire 102 within the groove 257. For example, the heated die may press the intermediate portion 121 of the first lead wire 102 into the plastic transducer basket 250 at the first location 252 and melt a portion of the plastic, securing the first lead wire 102 in place. In this example and others, a transducer basket 250 formed from plastic, which is an insulating material, may pose fewer potential problems with shorting the connection between the amplifier board and the voice coil 101 that might otherwise be present if the first lead wire 102 were directly connected to a transducer basket formed from metal.

In still further implementations, a clip or other fastener may be provided at the first location 252 on the transducer basket 250 for the purpose of securing the intermediate portion 121 of the first lead wire 102 in place, so as to maintain the shape of the first lead wire 102 over the spider 256. The clip or fastener may be provided in addition to, or independently of, any of the other examples discussed above. Other possibilities for affixing the first lead wire 102 to the transducer basket 250 also exist.

In addition, the plastic construction of the transducer basket 250 may facilitate the transducer basket 250 being integrally formed with at least a portion of an outer enclosure 242 of the loudspeaker 240, which can be seen in FIGS. 2 and 3. This may reduce the number of interconnecting parts in the loudspeaker 240, which may further reduce assembly time and cost. Further, the integral construction of the transducer basket 250 with at least a portion of the outer enclosure 242 may make the loudspeaker 240 more durable in some respects, as there may be fewer components that are susceptible to breakage if the loudspeaker 240 is knocked over or dropped. Such benefits might be desirable in a battery-powered, portable loudspeaker, for example, among other applications.

At block 608, the method 600 includes forming a second segment 117 of the second lead wire 105 into a second shape, similar to the examples discussed above with respect to the first lead wire 102. For example, the second segment 117 of the second lead wire 105 may have a predetermined second length between the proximal end 106 of the second lead wire 105 and an intermediate portion 122 of the second lead wire 105. In some implementations, the predetermined second length of the second segment 117 may be substantially the same as the predetermined first length of the first segment 116. Further, the second shape may be substantially the same as the first shape with a similar radius or radii of curvature, although in mirror image, as shown in FIG. 4.

As above, forming the second segment 117 into the first shape may be accomplished in any of the ways discussed above with respect to the first lead wire 102. In some implementations, after being used to form the first segment 116 into the first shape, the die 260 may be repositioned with respect to the transducer basket 250 and the voice coil assembly 100 to facilitate forming the second segment 117 into the second shape.

For example, as shown in FIG. 3, the die 260 may include a second die portion 362 opposite the first die portion 261. Forming the second shape may include positioning the die 260 such that the second die portion 362 is disposed between the voice coil 101 and a second location 253 on the transducer basket 250 where the second lead wire 105 will be attached. This may involve, for instance, rotating the die 260 approximately 180 degrees from the position shown in FIG. 2. A portion of the second segment 117 may then be extended along the second die portion 362, as described above.

Similar to the first die portion 261, the second die portion 362 may include a second convex shape 364. Extending the portion of the second segment 117 along and in contact with the second convex shape 364 of the second die portion 362 may form the second segment 117 into a concave shape that generally corresponds to the second convex shape 364 of the second die portion 362. Once the second lead wire 105 is secured in this position, as discussed below, the die 260 may then be removed. Thus, like the first lead wire 102, the second segment 116 of the second lead wire 105 may have a second shape that has a radius of curvature that is concave with respect to the spider 256. In some examples, as shown in FIG. 4, the profile of the second lead wire 102 may include several radii, each being generally concave with respect to the spider 256.

As previously discussed, the die 260 may be rotatably engaged with the voice coil 101. Accordingly, forming the second segment 117 of the second lead wire 105 into the second shape may include rotating the second die portion 362 in a second direction with respect to the voice coil 101 toward the second lead wire 105. For example, after repositioning the die 260 such that the second die portion 362 is situated between the first lead wire 102 and the second lead wire 105, the die 260 may be rotated in a counterclockwise direction via the knob 265 located at the top of the die 260. This rotation may move the second die portion 362 toward the second lead wire 105, as shown in FIG. 3.

As mentioned above, markings, indicia, or other features on the voice coil 101 or the spider 256 may indicate a designated position for the second die portion 362 that provides the desired length and shape for the second lead wire 105 when it is extended along the second die portion 362. For example, when the second die portion 362 is in the designated position and the second segment 117 is extended along the second die portion 362, the intermediate portion 122 of the second lead wire 105 may be aligned with a second location 253 on the transducer basket 250.

At block 610, the method 600 includes affixing the intermediate portion 122 of the second lead wire 105 to the second location 253 on the transducer basket 250. For instance, the second lead wire 105 may be affixed to the transducer basket 250 after it has been formed into the second shape using the die 260. Similar to the first lead wire 102, the affixing the second lead wire 105 to the transducer basket 250 may include positioning the intermediate portion 122 of the second lead wire 105 within a second groove 258 in the transducer basket 250, as shown in FIGS. 3 and 4. As above, the distal end 107 of the second lead wire 105 may then extend away from the second groove 258.

Attachment of the second lead wire 105 to the transducer basket 250 may be accomplished in any of the ways already discussed above. For example, a resilient adhesive 474 may be applied to maintain the second lead wire 105 within the groove 258, as seen in FIG. 4, or as an alternative to positioning the second lead wire 105 within the groove 258. The groove 258 may have serrated edges to hold the second lead wire 105. Additionally or alternatively, the intermediate portion 122 of the second lead wire 105 may be pressed into place by a heated die, as discussed above, which may melt a portion of the transducer basket 250 around the second lead wire 105. A clip or fastener may be included at the second location 253 in order the secure the second lead wire to the transducer basket 250, among other possibilities.

Figure 5:
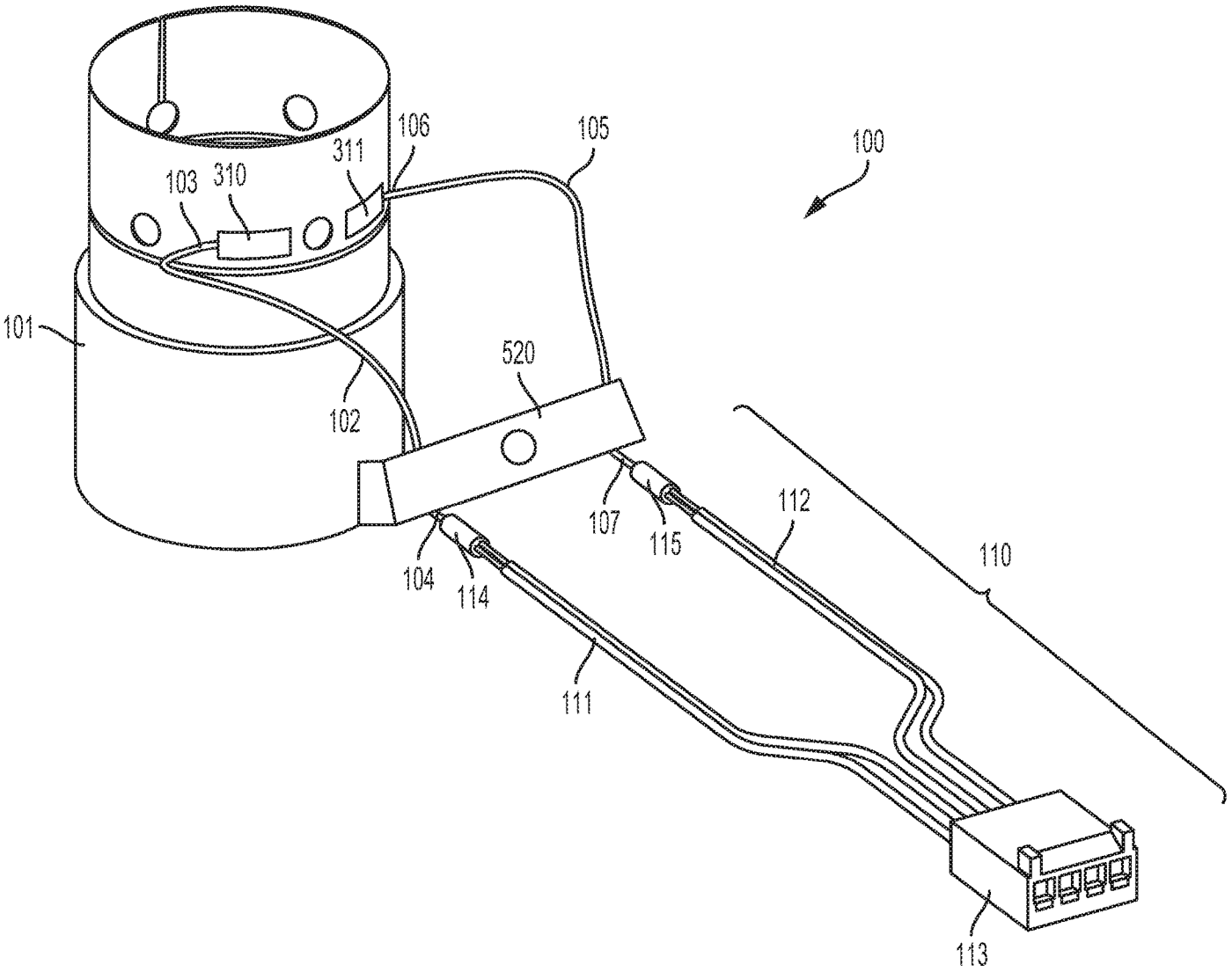
FIG. 5 is an isometric view of a voice coil assembly, according to an example embodiment.

An alternative configuration for the voice coil assembly 100 is shown in FIG. 5, in which a spacing member 520 is affixed to the intermediate portion 121 (FIG. 1) on the first lead wire 102 and to the intermediate portion 122 (FIG. 1) on the second lead wire 105. For example, the spacing member 520 may be a plastic component that is molded around the lead wires, or that is clamped into place or adhered to the respective intermediate portions of the lead wires 102 and 105. Other possibilities for attaching the spacing member 520 to the lead wires are also possible.

Further, utilizing the voice coil assembly 100 show in FIG. 5, affixing the respective intermediate portions of the first lead wire 102 and the second lead wire 105 as discussed above at blocks 606 and 610 may be accomplished simultaneously by affixing the spacing member 520 to the transducer basket 250. For example, the spacing member 520 may be riveted to, adhered to, or otherwise affixed to the transducer basket 250 in a designated position, which may be marked or otherwise indicated on the transducer basket 250, for example. This may place the respective intermediate portions of the first and second lead wires in substantially the same orientation and first and second locations 252 and 253 with respect to the transducer basket 250 as if they had been individually positioned as discussed in the examples above. Accordingly, in some implementations, the die 260 for forming the first and second lead wires 102 and 105 might not be needed.

At block 612, the method 600 includes conductively coupling the distal end 104 of the first lead wire and the distal end 107 of the second lead wire 105 to a lead wire harness 110 configured to directly connect to an amplifier board 470, as shown in FIG. 4 and discussed above. For instance, conductively coupling the respective distal ends 104 and 107 of the first lead 102 wire and the second lead wire 105 to the lead wire harness 110 may include joining the distal end 104 of the first lead wire 102 to the first harness lead 111, and joining the distal end 107 of the second lead wire 105 to the second harness lead 112.

As previously noted, coupling the lead wire harness 110 to the first lead wire 102 and the second lead wire 105 may take place before the voice coil assembly 100 is coupled to the transducer basket 250 or other components of the loudspeaker 240. In some implementations, the lengths of the first lead wire 102 and the second lead wire 105 between the voice coil 101 and the connection to the lead wire harness 110 may be established with a relatively low tolerance. Consequently, after the voice coil assembly 100 is coupled to the transducer basket 250, it may be possible to use the connections as a reference point by which to position the first lead wire 102 and second lead wire 105 with respect to the transducer basket 250.

For example, after the voice coil assembly 100 is coupled to the transducer basket 250, the insulated, heat-shrink tubing 114 that surrounds the connection between the first lead wire 102 and the first harness lead 111 may be positioned directly adjacent to the groove 257 in the transducer basket 250. This may position the intermediate portion 121 of the first lead wire 102 at the first location 252 on the transducer basket 250, without the need for either the die 260 or the spacing member 520 to establish the desired length of the first lead wire 102. The second lead wire 105 may be positioned in a similar way.

Figure 7:
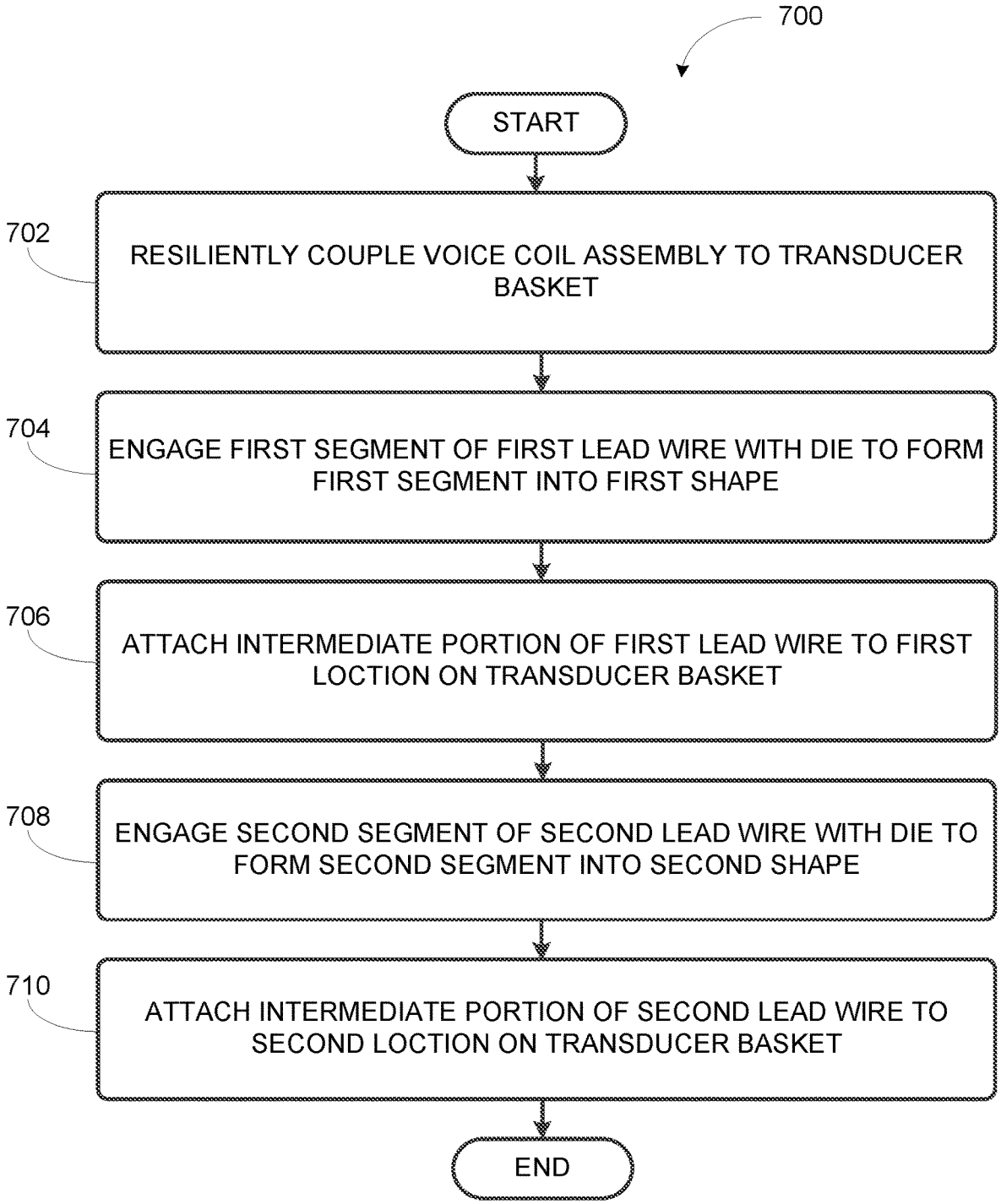
FIG. 7 is a flowchart of another example method of assembling a loudspeaker, according to an example implementation.

FIG. 7 is a flowchart of a method 700 for assembling a loudspeaker, such as the loudspeaker 240 shown in FIGS. 2-4, is shown. At block 702, the method 700 includes resiliently coupling a voice coil assembly, such as the voice coil assembly 100 discussed above and shown in FIG. 1, to a transducer basket, such as the transducer basket 250 shown in FIGS. 2-4. The voice coil assembly 100 may be resiliently coupled to the transducer basket 250 via the spider 256, as noted above. As discussed previously, the first and second lead wires 102 and 105 may have corresponding proximal and distal ends. The proximal ends 103 and 106 of the first and second lead wires 102 and 105 may be attached to the voice coil 101, and the distal ends 104 and 107 of the first and second lead wires 102 and 105 extend away from the voice coil 101.

In some implementations, the method 700 may involve conductively coupling the distal ends 104 and 107 of the first and second lead wires 102 and 105 to a lead wire harness, such as the lead wire harness 110 shown in FIG. 1 and discussed above. For instance, the lead wire harness 110 may be configured to directly connect to an amplifier board, such as the amplifier board 470 shown in FIG. 4. As mentioned previously, the lead wires may be conductively coupled to the lead wire harness 110 before the voice coil assembly 100 is otherwise coupled to the transducer basket 250.

At block 704, the method 700 includes engaging a first segment 116 of the first lead wire 102 with a die 260, as discussed above, to form the first segment 116 into a first shape. For instance, forming the first segment 116 into the first shape may include extending a portion of the first segment 116 along a first die portion 261, as shown in FIG. 2.

Further, the die 260 may be rotatably engaged with the voice coil 101, as detailed above, and forming the first segment 116 into the first shape may include moving the first die portion 261 in a first direction, such as a clockwise direction, with respect to the voice coil 101 toward the first lead wire 102. The first die portion 261 may have a first convex shapes 263, as seen in FIG. 2. Thus, the first shape of the first segment 116 may be a concave shape that generally corresponds to the first convex shape 263 of the first die portion 261.

At block 706, the method 700 includes attaching an intermediate portion 121 of the first lead wire 102 to a first location 252 on the trans2ucer basket 250. As discussed above, the intermediate portion 121 of the first lead wire 102 may be located on the first lead wire 102 between the first segment 116 and the distal end 104 of the first lead wire 102. Further, the first lead wire 102 may be attached to the transducer basket 250 in any of the ways mentioned above, among other possibilities.

At block 708, the method 700 may include engaging a second segment 117 of the second lead wire 105 with the die 260 to form the second segment 117 into a second shape. As noted previously, forming the second segment 117 into second shape may include extending a portion of the second segment 117 along a second die portion 362, as shown in FIG. 3. Further, forming the second segment 117 into the second shape may include moving the second die portion 362 in a second direction, such as a counterclockwise direction, with respect to the voice coil 101 toward the second lead wire 105, as discussed above. The second die portion 362 may have a second convex shape 364, and the second shape of the second segment 117 may be a concave shape that generally corresponds to the second convex shape of the second die portion 364.

At block 710, the method 700 may include attaching an intermediate portion 122 of the second lead wire 105 to a second location 253 on the transducer basket 250, as shown in FIG. 4. The intermediate portion 122 of the second lead wire 105 may be located on the second lead wire 105 between the first segment 117 and the distal end 107 of the first lead wire 105, as discussed above.

As discussed above, embodiments described herein may involve configurations of a loudspeaker and the assembly thereof. Methods 600 and 700 in FIGS. 6 and 7, respectively, may include one or more operations, functions, or actions as illustrated by one or more of blocks 602-612 and blocks 702-710. Although the blocks are illustrated in sequential order, these blocks may also be performed in parallel, and/or in a different order than those described herein, unless otherwise noted. Also, the various blocks may be combined into fewer blocks, divided into additional blocks, and/or removed based upon the desired implementation.

In addition, for the methods 600 and 700 and other processes and methods disclosed herein, the flowcharts show functionality and operation of one possible implementation of present embodiments. In this regard, each block may represent a module, a segment, or a portion of program code, which includes one or more instructions executable by one or more processors for implementing logical functions or steps in the process. For example, a processor may execute the instructions to cause one or more components of a robotic assembly system to carry out some or all of the loudspeaker assembly.

The program code may be stored on any suitable type of computer readable medium, for example, such as a storage device including a disk or hard drive. The computer readable medium may include non-transitory computer readable medium, for example, such as computer-readable media that stores data for short periods of time like register memory, processor cache and Random Access Memory (RAM). The computer readable medium may also include non-transitory media, such as secondary or persistent long term storage, like read only memory (ROM), optical or magnetic disks, compact-disc read only memory (CD-ROM), for example. The computer readable media may also be any other volatile or non-volatile storage systems. The computer readable medium may be considered a computer readable storage medium, for example, or a tangible storage device. In addition, for the methods 600 and 700 and other processes and methods disclosed herein, each block in FIGS. 6 and 7 may represent circuitry and/or machinery that is wired or arranged to perform the specific functions in the process.

III. Conclusion

The description above discloses, among other things, various example systems, methods, apparatus, and articles of manufacture including, among other components, firmware and/or software executed on hardware. It is understood that such examples are merely illustrative and should not be considered as limiting. For example, it is contemplated that any or all of the firmware, hardware, and/or software aspects or components can be embodied exclusively in hardware, exclusively in software, exclusively in firmware, or in any combination of hardware, software, and/or firmware. Accordingly, the examples provided are not the only way(s) to implement such systems, methods, apparatus, and/or articles of manufacture.

As indicated above, the examples involve a lead wire harness for use within a loudspeaker. In one aspect, a method of assembling a loudspeaker is provided. The method includes resiliently coupling a voice coil assembly to a transducer basket, where the voice coil assembly includes a voice coil, and first and second lead wires having corresponding proximal and distal ends, where the proximal ends of the first and second lead wires are attached to the voice coil, and where the distal ends of the first and second lead wires extend away from the voice coil. The method also includes forming a first segment of the first lead wire into a first shape, where the first segment of the first lead wire has a predetermined first length between the proximal end of the first lead wire and an intermediate portion of the first lead wire. The method also includes forming a second segment of the second lead wire into a second shape, where the second segment of the second lead wire has a predetermined second length between the proximal end of the second lead wire and an intermediate portion of the second lead wire. The method also includes affixing the intermediate portion of the first lead wire to a first location on the transducer basket, and affixing the intermediate portion of the second lead wire to a second location on the transducer basket. The method also includes conductively coupling the distal ends of the first and second lead wires to a harness configured to directly connect to an amplifier board.

In another aspect, a method of assembling a loudspeaker is provided. The method includes resiliently coupling a voice coil assembly to a transducer basket, where the voice coil assembly includes a voice coil, and first and second lead wires having corresponding proximal and distal ends, where the proximal ends of the first and second lead wires are attached to the voice coil, and where the distal ends of the first and second lead wires extend away from the voice coil. The method further includes engaging a first segment of the first lead wire with a die to form the first segment into a first shape, and engaging a second segment of the second lead wire with the die to form the second segment into a second shape. The method further includes attaching an intermediate portion of the first lead wire to a first location on the transducer basket, where the intermediate portion of the first lead wire is located on the first lead wire between the first segment and the distal end of the first lead wire. The method further includes attaching an intermediate portion of the second lead wire to a second location on the transducer basket, where the intermediate portion of the second lead wire is located on the second lead wire between the first segment and the distal end of the first lead wire.

In yet another aspect, a loudspeaker is provided. The loudspeaker includes a voice coil assembly including a voice coil, a first lead wire having a proximal end and a distal end, where a proximal end of the first lead wire is conductively coupled to the voice coil, a second lead wire having a proximal end and a distal end, where a proximal end of the second lead wire is conductively coupled to the voice coil, and a lead wire harness conductively coupled to the distal end of the first lead wire and the distal end of the second lead wire. The loudspeaker also includes a transducer basket flexibly coupled to the voice coil, where the first lead wire is affixed to the transducer basket at an intermediate portion on the first lead wire, where the intermediate portion on the first lead wire is located a predetermined first length from the proximal end of the first lead wire and the distal end of the first lead wire, where the second lead wire is affixed to the transducer basket at an intermediate portion on the second lead wire, where the intermediate portion on the second lead wire is located a predetermined second length from the proximal end of the second lead wire and the distal end of the second lead wire, and where the lead wire harness extends away from the transducer basket.

Additionally, references herein to "embodiment" means that a particular feature, structure, or characteristic described in connection with the embodiment can be included in at least one example embodiment of an invention. The appearances of this phrase in various places in the specification are not necessarily all referring to the same embodiment, nor are separate or alternative embodiments mutually exclusive of other embodiments. As such, the embodiments described herein, explicitly and implicitly understood by one skilled in the art, can be combined with other embodiments. [71] The specification is presented largely in terms of illustrative environments, systems, procedures, steps, logic blocks, processing, and other symbolic representations that directly or indirectly resemble the operations of data processing devices coupled to networks. These process descriptions and representations are typically used by those skilled in the art to most effectively convey the substance of their work to others skilled in the art. Numerous specific details are set forth to provide a thorough understanding of the present disclosure. However, it is understood to those skilled in the art that certain embodiments of the present disclosure can be practiced without certain, specific details. In other instances, well known methods, procedures, components, and circuitry have not been described in detail to avoid unnecessarily obscuring aspects of the embodiments. Accordingly, the scope of the present disclosure is defined by the appended claims rather than the forgoing description of embodiments.

When any of the appended claims are read to cover a purely software and/or firmware implementation, at least one of the elements in at least one example is hereby expressly defined to include a tangible, non-transitory medium such as a memory, DVD, CD, Blu-ray, and so on, storing the software and/or firmware.

We claim:

1. A method of assembling a loudspeaker, the method comprising:

resiliently coupling a voice coil assembly to a transducer basket, wherein the voice coil assembly comprises a voice coil, and first and second lead wires having corresponding proximal and distal ends, wherein the proximal ends of the first and second lead wires are attached to the voice coil, and wherein the distal ends of the first and second lead wires extend away from the voice coil;

forming a first segment of the first lead wire into a first shape, wherein the first segment of the first lead wire has a predetermined first length between the proximal end of the first lead wire and an intermediate portion of the first lead wire;

affixing the intermediate portion of the first lead wire to a first location on the transducer basket;

forming a second segment of the second lead wire into a second shape, wherein the second segment of the second lead wire has a predetermined second length between the proximal end of the second lead wire and an intermediate portion of the second lead wire;

affixing the intermediate portion of the second lead wire to a second location on the transducer basket; and conductively coupling the distal ends of the first and second lead wires to a lead wire harness configured to directly connect to an amplifier board.

2. The method of claim 1, wherein resiliently coupling the voice coil assembly to the transducer basket comprises resiliently coupling the voice coil assembly to the transducer basket via a suspension element, and wherein forming the first segment of the first lead wire into the first shape comprises forming the first segment of the first lead wire into the first shape such that the first shape is concave with respect to the suspension element.

3. The method of claim 1, further comprising:

positioning a die with respect to the transducer basket and the voice coil assembly such that a portion of the die is disposed between the voice coil and the first location on the transducer basket.

4. The method of claim 3, wherein positioning the die comprises slidably engaging the voice coil with the die.

5. The method of claim 4, wherein the portion of the die is a first die portion, and wherein the die further includes a second die portion.

6. The method of claim 5, wherein forming the first shape comprises extending a portion of the first segment along the first die portion, and wherein forming the second shape comprises extending a portion of the second segment along the second die portion.

7. The method of claim 5, wherein the die is rotatably engaged with the voice coil, and wherein forming the first segment of the first lead wire into the first shape comprises moving the first die portion in a first direction with respect to the voice coil toward the first lead wire, and wherein forming the second segment of the second lead wire into the second shape comprises moving the second die portion in a second direction with respect to the voice coil toward the second lead wire.

8. The method of claim 5, wherein the first die portion and the second die portion have associated first and second concave shapes, and wherein the first shape of the first segment is a convex shape that generally corresponds to the first concave shape of the first die portion, and wherein the second shape of the second segment is a second convex shape that generally corresponds to the second concave shape of the second die portion.

9. The method of claim 1, wherein affixing the first lead wire to the transducer basket comprises positioning the intermediate portion of the first lead wire within a first groove in the transducer basket, and wherein affixing the second lead wire to the transducer basket comprises positioning the intermediate portion of the second lead wire within a second groove in the transducer basket.

10. The method of claim 1, further comprising:

attaching a spacing member to the respective intermediate portions on the first and second lead wires, wherein affixing the respective intermediate portions of the first lead wire and the second lead wire to the transducer basket comprises affixing the spacing member to the transducer basket.

* * * * *